US011013348B2

(12) United States Patent
Sullivan et al.

(10) Patent No.: US 11,013,348 B2
(45) Date of Patent: May 25, 2021

(54) SYSTEM AND METHOD FOR INFANT SECURING DEVICE

(71) Applicants: Huixiang Sullivan, Coppell, TX (US); Matthew Sullivan, Coppell, TX (US)

(72) Inventors: Huixiang Sullivan, Coppell, TX (US); Matthew Sullivan, Coppell, TX (US)

( * ) Notice: Subject to any disclaimer, the term of this patent is extended or adjusted under 35 U.S.C. 154(b) by 0 days.

(21) Appl. No.: 16/874,253

(22) Filed: May 14, 2020

(65) Prior Publication Data

US 2020/0375372 A1 Dec. 3, 2020

Related U.S. Application Data

(60) Provisional application No. 62/847,935, filed on May 14, 2019.

(51) Int. Cl.

| | |
|---|---|
| ***A47D 15/00*** | (2006.01) |
| ***A47G 9/02*** | (2006.01) |
| ***A47G 9/04*** | (2006.01) |
| ***A41B 13/06*** | (2006.01) |

(52) U.S. Cl.

CPC ..... *A47D 15/008* (2013.01); *A41B 13/065* (2013.01); *A47D 15/001* (2013.01); *A47G 9/0223* (2013.01); *A47G 9/0238* (2013.01); *A47G 9/04* (2013.01); *A41B 2300/322* (2013.01)

(58) Field of Classification Search

CPC .. A41B 2300/322; A41B 13/065; A47D 5/00; A47D 15/001; A41F 9/002; A61G 1/044; A47G 9/04; A47G 9/00; A47G 9/02; A47G 9/0207; A47G 9/0223; A47G 9/0238; A47C 21/022; A61B 6/0421

USPC ..... D24/193; 128/872

See application file for complete search history.

(56) References Cited

U.S. PATENT DOCUMENTS

| | | | | |
|---|---|---|---|---|
| 1,460,233 | A * | 6/1923 | Drew | A47G 9/04 5/494 |
| 2,450,923 | A * | 10/1948 | Spiro, Jr. | A47G 9/04 5/499 |
| 2,619,958 | A * | 12/1952 | Day | A41B 13/00 128/876 |
| 2,637,047 | A | 5/1953 | Zurzolo | |
| 2,644,962 | A * | 7/1953 | McCrory | A47G 9/04 5/494 |
| 3,474,781 | A * | 10/1969 | Gaylord, Jr. | A61F 5/3784 128/876 |
| 4,573,227 | A * | 3/1986 | Prandina | A47G 9/0207 5/486 |

(Continued)

FOREIGN PATENT DOCUMENTS

CA 2363346 A1 5/2003

OTHER PUBLICATIONS

Snoozzz Sleep Positioner, Snoozzz.com, https://www.snoozzz.com/products [date accessed Jan. 31, 2019].

*Primary Examiner* — David R Hare
*Assistant Examiner* — Amanda L Bailey
(74) *Attorney, Agent, or Firm* — Christopher Mayle; Thomas E. LaGrandeur; Bold IP, PLLC

(57) ABSTRACT

A system and method for an infant securing apparatus that allows for infants to remain safely in a crib wherein the infant is prevented from rolling over on their stomach, sit, or stand up and injure themselves, the apparatus having a stable blanket to keep an infant warm while avoiding the infant being suffocated by the blanket.

12 Claims, 15 Drawing Sheets

(56) References Cited

U.S. PATENT DOCUMENTS 4,861,109 A * 8/1989 Leach ..... A47D 15/006 297/467
5,086,758 A * 2/1992 Schiek, Sr. ..... A61F 5/028 128/876
5,309,926 A * 5/1994 Mayton ..... A47D 5/00 128/869
5,439,008 A 8/1995 Bowman
D382,642 S * 8/1997 Van Gisbergen Rutherford ..... D24/190
5,746,219 A 5/1998 McConnell
6,134,730 A * 10/2000 Evanson ..... A47G 9/02 5/482
7,111,344 B2 * 9/2006 French ..... A41B 13/06 128/872
7,603,732 B2 * 10/2009 Robles ..... A47D 15/008 128/872
8,127,385 B1 * 3/2012 Goutevenier ..... A47D 13/08 5/655
10,051,969 B2 8/2018 Galloway
10,368,654 B2 * 8/2019 Sopher ..... A47C 21/028
2003/0154549 A1 * 8/2003 Landry ..... A47D 15/008 5/494
2005/0210585 A1 * 9/2005 French ..... A47D 15/008 5/494
2007/0094795 A1 * 5/2007 Byrne ..... A61F 5/3776 5/494
2010/0287706 A1 * 11/2010 Nour ..... A47D 15/008 5/655
2011/0179546 A1 * 7/2011 Millette ..... A41B 13/06 2/75
2015/0182043 A1 * 7/2015 Vickerman ..... A61F 5/3784 5/494
2015/0327689 A1 * 11/2015 Howard ..... A47D 15/00 5/655
2016/0295928 A1 * 10/2016 Bopanna ..... A41B 13/06
2018/0228222 A1 * 8/2018 Barski ..... A41B 13/06

* cited by examiner

SYSTEM AND METHOD FOR INFANT SECURING DEVICE

CROSS REFERENCE TO RELATED APPLICATIONS

This application claims priority to U.S. Provisional Application No. 62/847,935 filed on May 14, 2019, which is incorporated by reference in its entirety.

FIELD OF DISCLOSURE

The overall field of this invention relates generally to an infant accessory and more particularly to an accessory for use with a conventional baby crib to provide safety for the infant to avoid rolling over on their stomach, or sit up or stand up as well as keep the infant warm while avoiding suffocating the infant.

BACKGROUND

Younger infants typically exhibit uncontrolled movements while asleep and when awake they often roll and move around. Unless confined, such movements may possibly cause injury to the child. Studies have shown that infants who sleep on their stomachs have an increased risk of Sudden Infant Death Syndrome (SIDS), compared to infants who sleep on their backs. For this reason, infants are often placed in cradles and other systems to protect against the effects of sudden movement such as by rolling over onto their stomachs.

Customarily there have been other apparatus to secure an infant such as a baby wrap. However baby wraps only work for early aged baby whom cannot yet roll over, sit up or stand up. Babies also suffer with the baby wraps if they have already rolled over. The infant then cannot roll back because the baby's arm and legs may have gotten tied up with the wrap, creating an even more dangerous situation. Infants also cannot move and relax their arms and feet, making them more upset. Pediatric doctors also suggest not to use any blanket or dolls on a bed leaving infants to wear layers to keep their bodies warm or turning the heat up without any blanket. Thus, there exists a need for a safe, comfortable, adjustable, multifunctional, suitable, warm baby wrap, bed sheet, and blanket.

SUMMARY

The present invention is directed to a system for securing infants, the system comprising: a mattress, a bed sheet, a safety belt configured to wrap around the bed sheet and the mattress, the safety belt securing an infant in a selected position on their back, the safety belt having one or more release buckles, the safety belt having a first component of the release buckle on a surface and a second component on the safety belt, the second component configured to cooperate with the first component, wherein the flap is configured to pass through a slot on the safety belt and then folded over wherein the first component is connected to the second component securing the safety belt over the infant, further comprising: a swaddle, the swaddle having a front panel and back panel, the front panel and the back panel removably connected to each other by a zipper element, the swaddle removably fastened to the safety belt, further comprising: a blanket configured to cover an area of the infant, the blanket removably fastened to the bed sheet, the blanket vertically adjustable with respect to the bed sheet, the blanket and the bed sheet having one or more strips wherein the strips of the blanket are configured to be tied to one or more of the one or more strips of the bed sheets such that the blanket covers an area of the infant, the safety belt comprising a series of release buckles having male components and female components, the male and the female components configured to cooperate with each other, wherein the release buckles are configured to secure the safety belt over the bed sheet and the mattress.

The present invention is also directed to a system for securing infants, the system comprising: a safety belt, the safety belt having a safety wrap component, the safety belt securing an infant in a selected position on their back on a bed, the safety belt having one or more release buckles, the safety belt having a first component of the release buckle on a section and a second component on the safety belt, the second component configured to cooperate with the first component, wherein the flap is configured to pass through a slot on the safety belt and then folded over wherein the first component is connected to the second component securing the safety belt over the infant, further comprising: a blanket configured to cover an area of the infant, the blanket removably fastened to the bed, the blanket vertically adjustable with respect to the bed, the blanket having one or more strips configured to be removably fastened to the bed, the blanket vertically adjustable with respect to the bed before the one or more strips are fastened to the bed wherein when the blanket is positionable at multiple orientations with respect to the bed, further comprising: a swaddle wearable by the infant, the swaddle removably fastened to the safety belt.

The present invention also directed to a system for securing infants, the system comprising: a mattress, a bed sheet, a blanket configured to be positioned over an area infant, a safety belt configured to wrap around the bed sheet and the mattress, the safety belt an infant in a selected position on their back, further comprising: a swaddle, the swaddle having a front panel and back panel, the front panel and the back panel removably connected to each other by a fastening element, the swaddle removably connected to the safety belt, the blanket having one or more buttons, the bed sheet having one or more holes configured to receive the one or more buttons, the blanket vertically adjustable with respect to the bed sheet before the one or more buttons are received into the one or more holes wherein the blanket is positionable at multiple orientations with respect to the bed sheet when secured, the bed sheet having one or more slits wherein the buttons of the blanket are configured to pass through the one or more slits to be received by the one or more holes, the safety belt having one or more release buckles, the safety belt having a first component of the release buckle on a section and a second component on the safety belt, the second component configured to cooperate with the first component, wherein the safety belt is configured to pass through a slot on the safety belt and then folded over wherein the first component is connected to the second component securing the safety belt over the infant.

BRIEF DESCRIPTION OF DRAWINGS

The present invention will be described by way of exemplary embodiments, but not limitations, illustrated in the accompanying drawings in which like references denote similar elements, and in which.

DETAILED DESCRIPTION

Figure 1:
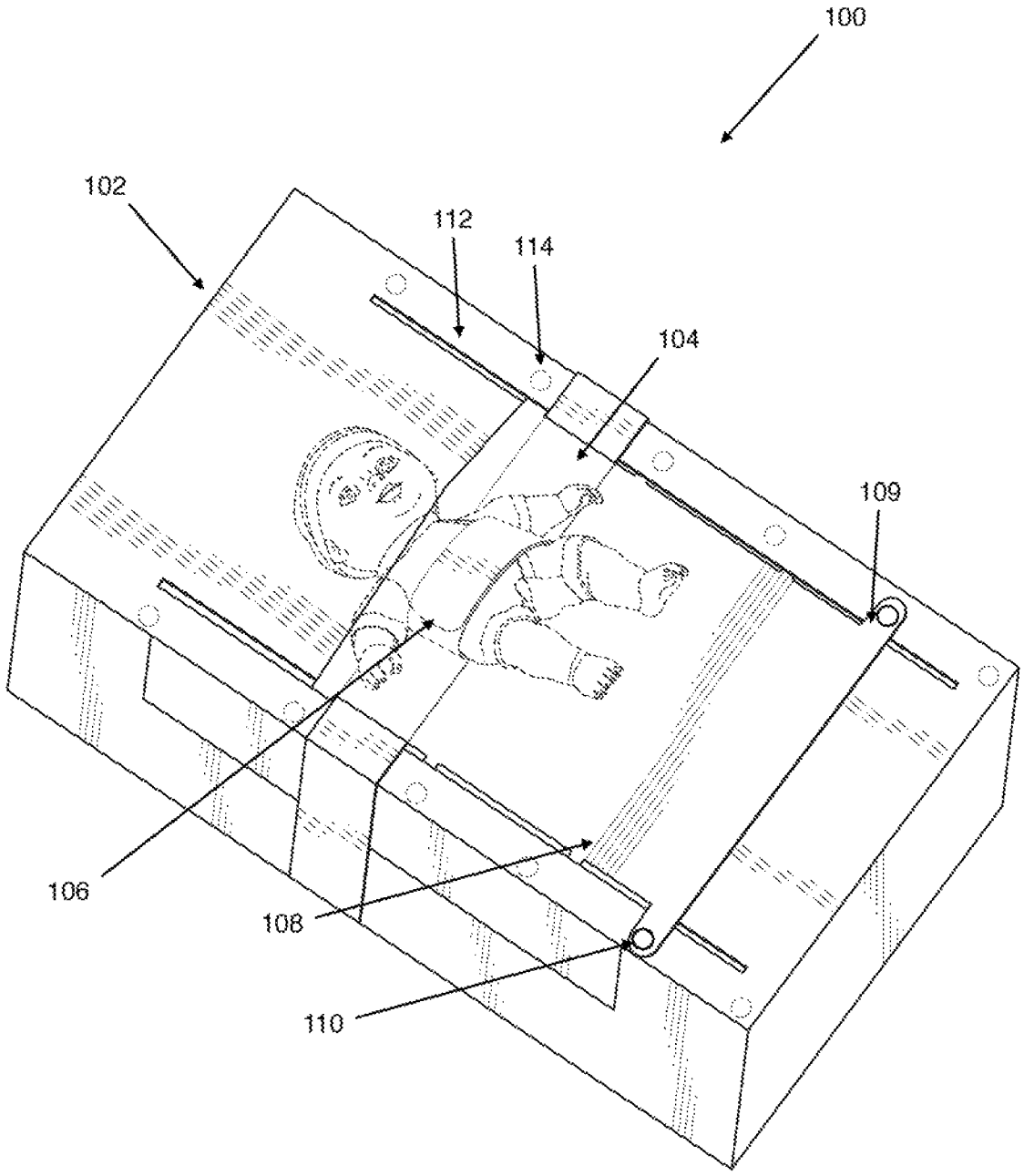
FIG. 1 depicts a top perspective view of a first embodiment of the present invention.
Figure 2:
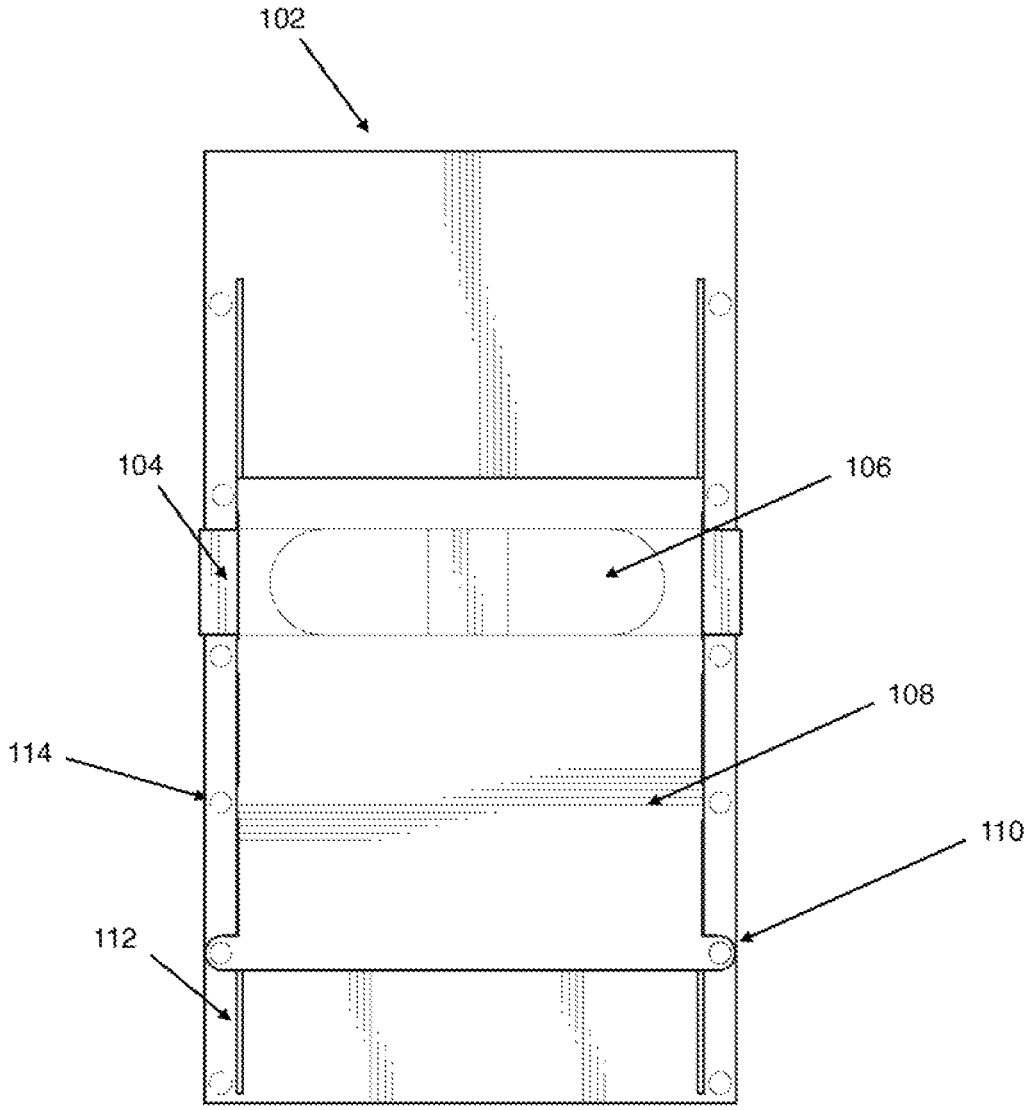
FIG. 2 depicts a top view of the first embodiment.
Figure 3:
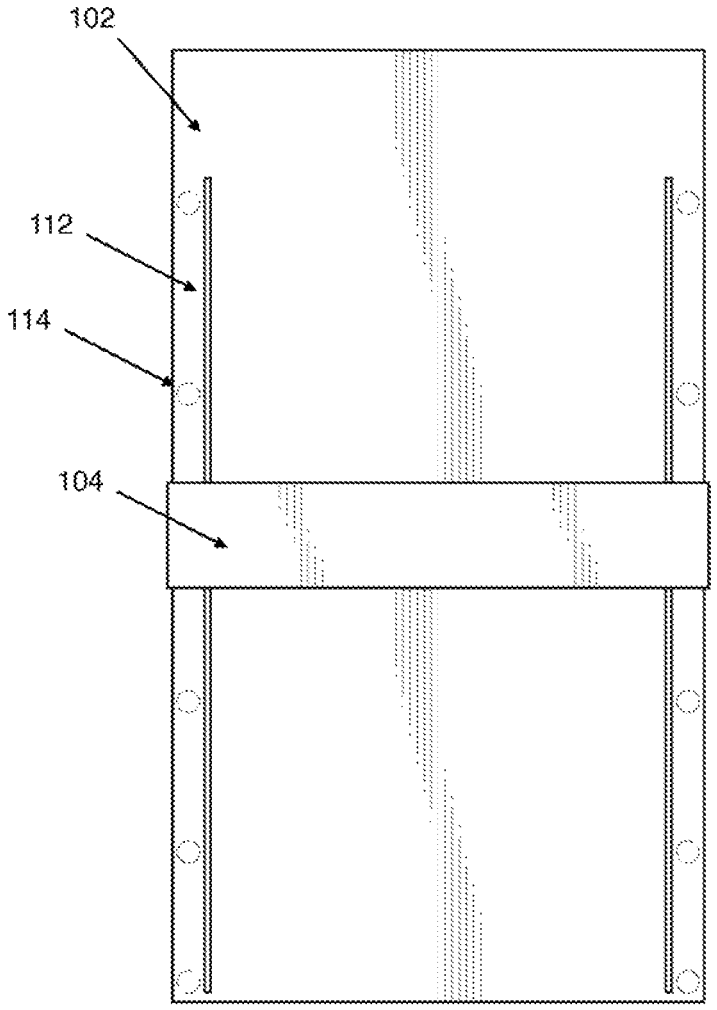
FIG. 3 depicts a bottom view of the first embodiment.
Figure 4:
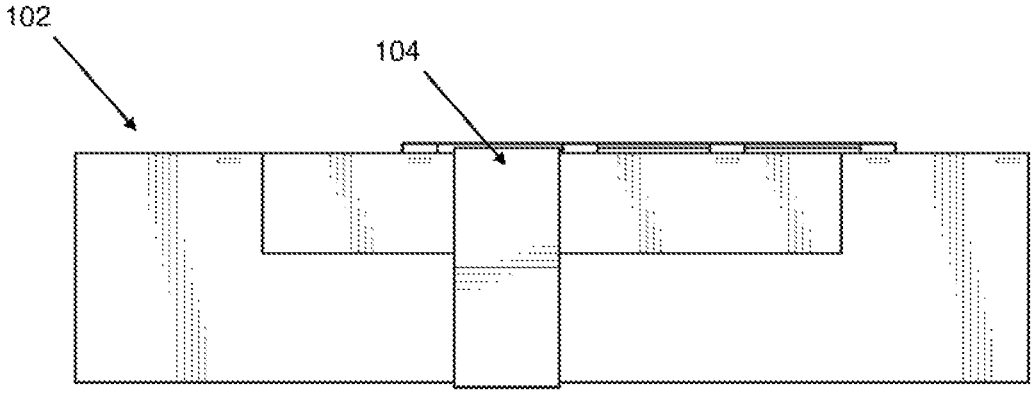
FIG. 4 depicts a side view of the first embodiment.
Figure 5:
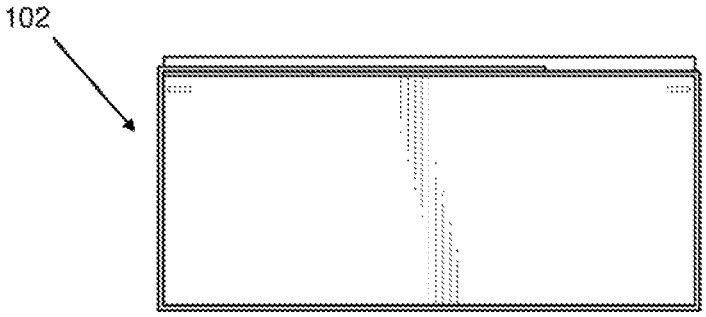
FIG. 5 depicts a front view of the first embodiment.
Figure 6:
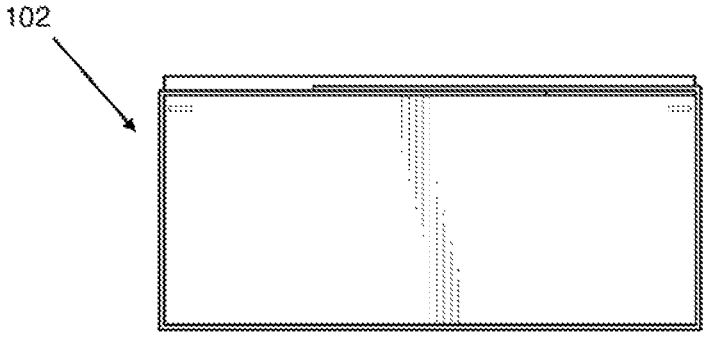
FIG. 6 depicts a back view of the first embodiment.

In the Summary above and in this Detailed Description, and the claims below, and in the accompanying drawings, reference is made to particular features (including method steps) of the invention. It is to be understood that the disclosure of the invention in this specification includes all possible combinations of such particular features. For example, where a particular feature is disclosed in the context of a particular aspect or embodiment of the invention, or a particular claim, that feature can also be used, to the extent possible, in combination with and/or in the context of other particular aspects and embodiments of the invention, and in the invention generally.

The term "comprises", and grammatical equivalents thereof are used herein to mean that other components, ingredients, steps, among others, are optionally present. For example, an article "comprising" (or "which comprises") components A, B, and C can consist of (i.e., contain only) components A, B, and C, or can contain not only components A, B, and C but also contain one or more other components.

Where reference is made herein to a method comprising two or more defined steps, the defined steps can be carried out in any order or simultaneously (except where the context excludes that possibility), and the method can include one or more other steps which are carried out before any of the defined steps, between two of the defined steps, or after all the defined steps (except where the context excludes that possibility).

The term "at least" followed by a number is used herein to denote the start of a range beginning with that number (which may be a range having an upper limit or no upper limit, depending on the variable being defined). For example, "at least 1" means 1 or more than 1. The term "at most" followed by a number (which may be a range having 1 or 0 as its lower limit, or a range having no lower limit, depending upon the variable being defined). For example, "at most 4" means 4 or less than 4, and "at most 40%" means 40% or less than 40%. When, in this specification, a range is given as "(a first number) to (a second number)" or "(a first number)-(a second number)," this means a range whose limit is the second number. For example, 25 to 100 mm means a range whose lower limit is 25 mm and upper limit is 100 mm.

Certain terminology and derivations thereof may be used in the following description for convenience in reference only and will not be limiting. For example, words such as "upward," "downward," "left," and "right" would refer to directions in the drawings to which reference is made unless otherwise stated. Similarly, words such as "inward" and "outward" would refer to directions toward and away from, respectively, the geometric center of a device or area and designated parts thereof. References in the singular tense include the plural, and vice versa, unless otherwise noted.

The present disclosure recognizes the unsolved need for a system and method for an infant securing apparatus that allows for infants to remain safely on a crib wherein the infant is prevented from rolling over on their stomach, sit, or stand up and injure themselves. The invention also provides a stable blanket to keep an infant warm while avoiding the infant being suffocated by the blanket.

With reference now to FIG. 1, one embodiment of infant securing system 100 according to the present invention is generally designated. FIG. 1 illustrates a perspective view of a fitted bed sheet such as bed sheet 102 to be fit over or to a mattress or other apparatus wherein bed sheet 102 provides corners that grab the corners of the mattress for a form fit. Bed sheet 102 may be made of a breathable, stretchable, moisture absorbable fabric. For instance, the material may be, but is not limited to, a knit material such as a cotton based fabric, silk, sateen, cotton blend, linen, polyester, or polypropylene fabric. Bed sheet 102 may be cut out of a pattern on knit material or formed by any method known by those of ordinary skill in the art.

Bed sheet 102 may include one or more bands of resilient material having a greater modulus of elasticity than that of the bed sheet, whereby the bands may be secured within the bed sheet proximally against the outer perimeter of bed sheet 102. Bed sheet 102 may have sewn openings or hem whereby the resilient material may be inserted into the openings and then secured by the openings being fastened closed. The bands may be in a tensile state such that they add rotational forces against the bed sheet when expanded. The resilient material for the bands may be selected according to their modulus of elasticity to tightly engage each of the lines of dependency such that the cover body will remain firmly engaged against all surfaces including the mattress when positioned over the mattress. Bed sheet 102 of the present invention may also pertain to all top sheets, including but not limited to blankets, coverlets, quilts, duvets, mattress pads, bed spreads and comforters or any other top sheet which comes into contact with the mattress with an elastomer or any material which would tend to cling to a mattress to further enhance the securing the top sheet to the mattress.

Bed sheet 102 may have one or more slits such as slits 112. Slits 112 of bed sheet 102 run vertically across the top surface of bed sheet 102, preferably, with the length of the slit the same or less than the as the length of the mattress. Slits 112 are designed not to just be a plain opening cut across the top surface of bed sheet 112 but also to as an opening whereby a series of button holes such as button holes 114 may be located.

Button holes 114 may be provided through bed sheet 102 or through an inner layer of bed sheet 102 at regular widthwise-intervals that match the location and spacing of buttons such as buttons 110 of a blanket such as blanket 108. Button holes 112 are provided spaced from the bottom of bed sheet 102 at a pre-selected distance. Button holes 112 may be provided through a guide rail. Button holes 112 may be provided through twill tape that is attached to bed sheet 102 at predetermined distance from the base of bed sheet 102.

Blanket 108 may be generally rectangular in shape having a top surface, a bottom surface, and borders. Blanket 108 may be made of one layer or a multilayer of fabric material. The fabric material suitable for making blanket 108 may be dependent on the environmental conditions such as a thin sheet of cotton may be used for warm weather while wool and quilted multilayer of fabric may be used in cold weather. The fabric may be natural, man-made, synthetic or blended. Blanket 108 may be plain or with a design including indicia or logos tailored to infants.

Blanket 108 may have several perpendicularly positioned flaps or edge portions such as flaps 109. Flaps may also be orientated at other angles depending on the circumstance and current need. Buttons 110 may be centrally positioned on the flaps 109 of blanket 108 or along the edges of the flaps. Buttons 110 may be used to connect blanket 108 and bed sheet 102 wherein buttons 110 are removably fastened into button holes 114 in slits 112 of bed sheet 102. Buttons 110 along flaps 109 of blanket 108 may be redundant so that either end of blanket 108 be placed by the base of bed sheet 102. Also, if buttons 110 are missing from one end of blanket 108, blanket 108 may then be turned around wherein buttons 110 from the opposite end may be used, extending the life of infant securing system 100. Several pairs of buttons 110 and button holes 114 may be in different sizes and arrangement may be provided to accommodate infants of different lengths.

Bed sheet 102 may include one or more straps made of fabric or flexible plastic strips having a first end and a second end, and first and second face wherein straps are secured to the mattress by wrapping around the underside of the mattress. However plastic is non-limiting and any material in the spirit of the present invention may be used. The first end of the straps contains the second face, which includes loops configured to connect or otherwise communicate with the hooks of second face on the second end of straps to complete the hook and loop fastener. Such material is sold under the trade name "Velcro". When the first face and second face are connected the connection provides for further securing of bed sheet 102 to the mattress. Other embodiments have buttons and eyelets, draw string, zippers, straps, or ties instead of hook and loop fasteners to secure the first and second face together. In further embodiments a strap may be separate from a bed sheet.

An adjustable safety belt such as safety belt 104 may wrap around bed sheet 102 and mattress. Safety belt 104 may be made of a fabric or flexible plastic and include a strap having a first end and second end, and first and second face. The first end of safety belt 104 contains a first face, which includes loops configured to connect or otherwise communicate with the hooks of second face on a second end of the strap to complete the hook and loop fastener. When the first face and second face are connected the connection provides for securing safety belt 104 to bed sheet 102 and the mattress to secure an infant who is placed or otherwise positioned in adjustable safety wrap such as safety wrap 106. Other embodiments have buttons and eyelets, draw string, zippers, straps, or ties instead of hook and loop fasteners to secure the first face to the second face.

Safety wrap 106 may be sewn or otherwise fastened to the top of safety belt 104 whereby safety wrap 104 may be folded over to help secure the infant in a selected position.

To connect safety belt 104 to safety wrap 106 a series of release buckles may be used including a pair of male components on the arms and cooperating female component on the safety belt 104. Female components may be connected to and positioned inside pockets having openings built into the belt. The pockets may comprise chambers for containing the female components so that the male components may connect with the female components inside of the chamber but an infant would not be able to come in contact with the buckles while secured within the wings. The chambers are preferably of the same size and shape but may be of any shape or size depending on the circumstances.

To fasten the buckles, spring arms of the male component may be inserted into opening of female component with the center guide sliding into the center channel to align the male and female components. The spring arms of the male component expand into release openings of the female component as the buckle is closed with the shoulder of each spring arm engaging the edge of the release opening. To release the buckle, the user presses the spring arms together, to disengage them from release openings and thereby allow the male and female components to separate. Buckles may include a webbing receiving portion for receiving a webbing strap. One or both components of the buckle may include a pair of slots separated by a bar to secure the webbing strap when it is threaded through the first slot, over the bar, back through slot and under the bar. The length of the strap may be adjusted by sliding the strap through the slots. When adjusting is not needed buckle may only have one slot.

In one or more non-limiting embodiments, infant may also be wearing pajamas or another article of clothing that may be fastened to safety wrap 106 by a series of release buckles on the back of the article of clothing that connect to safety wrap 106 in a similar fashion to the connections between the safety belt 104 and safety wrap 106.

In other non-limiting embodiments safety wrap 106 may instead be cotton receiving blankets, cotton muslin wraps, or specialized "winged" baby swaddles that are sewn or otherwise fastened to safety belt 104 whereby the infant may be placed with their arms in to reduce startle reflux, hands to face for self-soothing, and one or two arms out for an easy transition from swaddling.

One method of use may begin with the bands of resilient material being pulled over with bed sheet 102 connected to the mattress, whereby the bands are secured over the outer perimeter of the mattress. Safety belt 104 may then be wrapped and fastened around bed sheet 102 and mattress. Infant is then positioned in place over safety wrap 106. When an infant lies down with their back positioned on top of safety wrap 106, safety wrap 106 may then be pulled and fastened thus securing the infant in place. Blanket 108 may then be positioned over the infant wherein buttons 110 on flaps 109 are fastened to button holes 114 in slits 112 of bed sheet 102 and thus out of reach of the infant. With an infant secured in safety wrap 106 and blanket 108 positioned over infant, the infant may sleep safely and securely within infant securing system 100.

Figure 7:
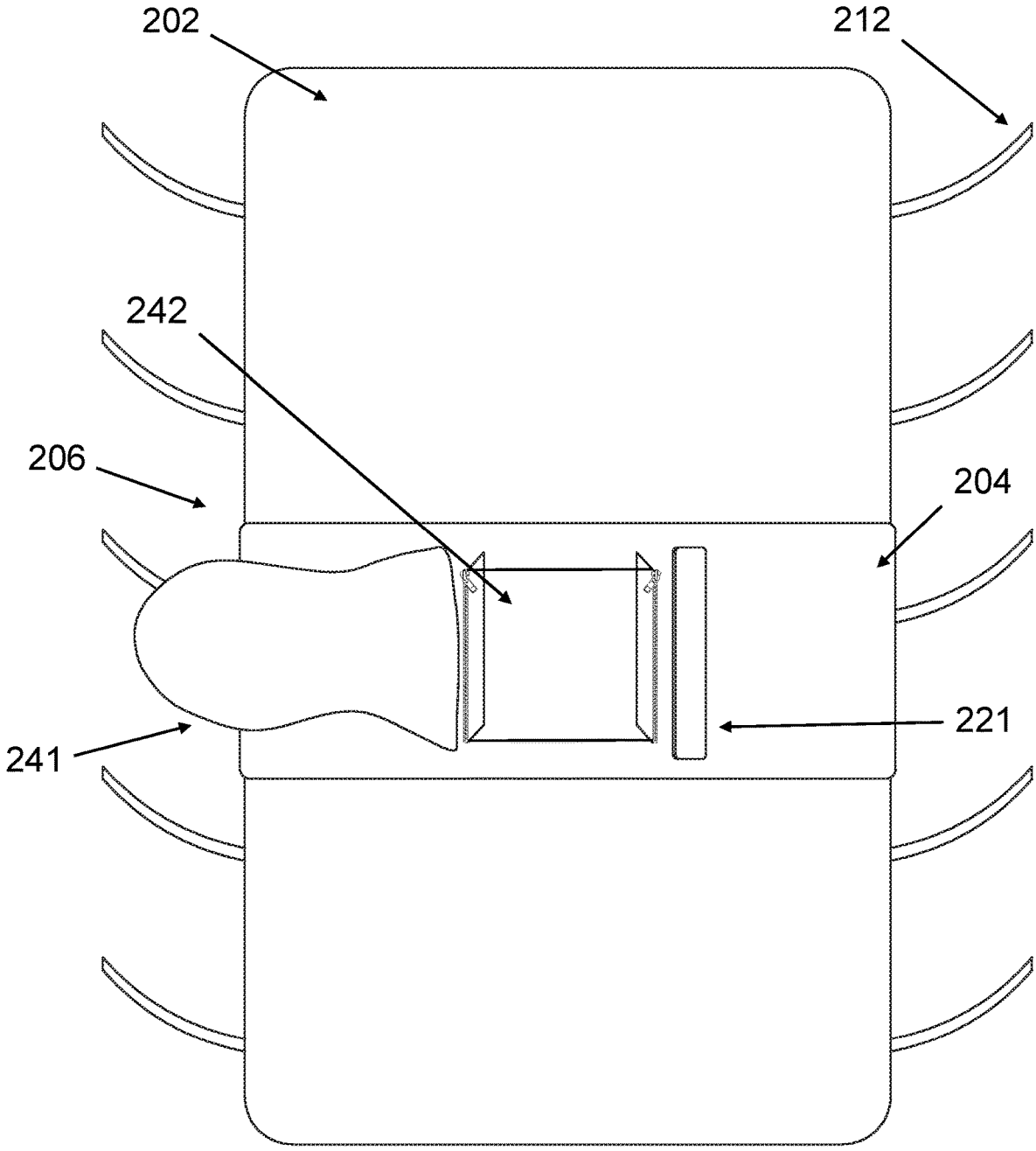
FIG. 7 depicts a top view of the second embodiment of the present invention.

With reference now to FIG. 7, another embodiment of infant securing system 200, according to the present invention is generally designated. FIG. 7 illustrates a top view of a fitted bed sheet such as bed sheet 202 to be fit over or to a mattress or other apparatus wherein bed sheet 202 provides corners that grab the corners of the mattress for a form fit.

Bed sheet 202 may include one or more bands of resilient material having a greater modulus of elasticity than that of the bed sheet, whereby the bands may be secured within the bed sheet proximally against the outer perimeter of bed sheet 202. Bed sheet 202 may have sewn openings or hem whereby the resilient material may be inserted into the openings and then secured by the openings being fastened closed. The bands may be in a tensile state such that they add rotational forces against the bed sheet when expanded.

Bed sheet 202 may have one or more strips such as strips 212. Strips 212 of bed sheet 202 run horizontally across the outer edges of the bottom of bed sheet 202, preferably, with the length of strips 212 positioned a long a length the same or less than the as the length of the mattress. In some embodiments strips 212 are spaced from the top or bottom of bed sheet 212 at pre-selected intervals.

Figure 8:
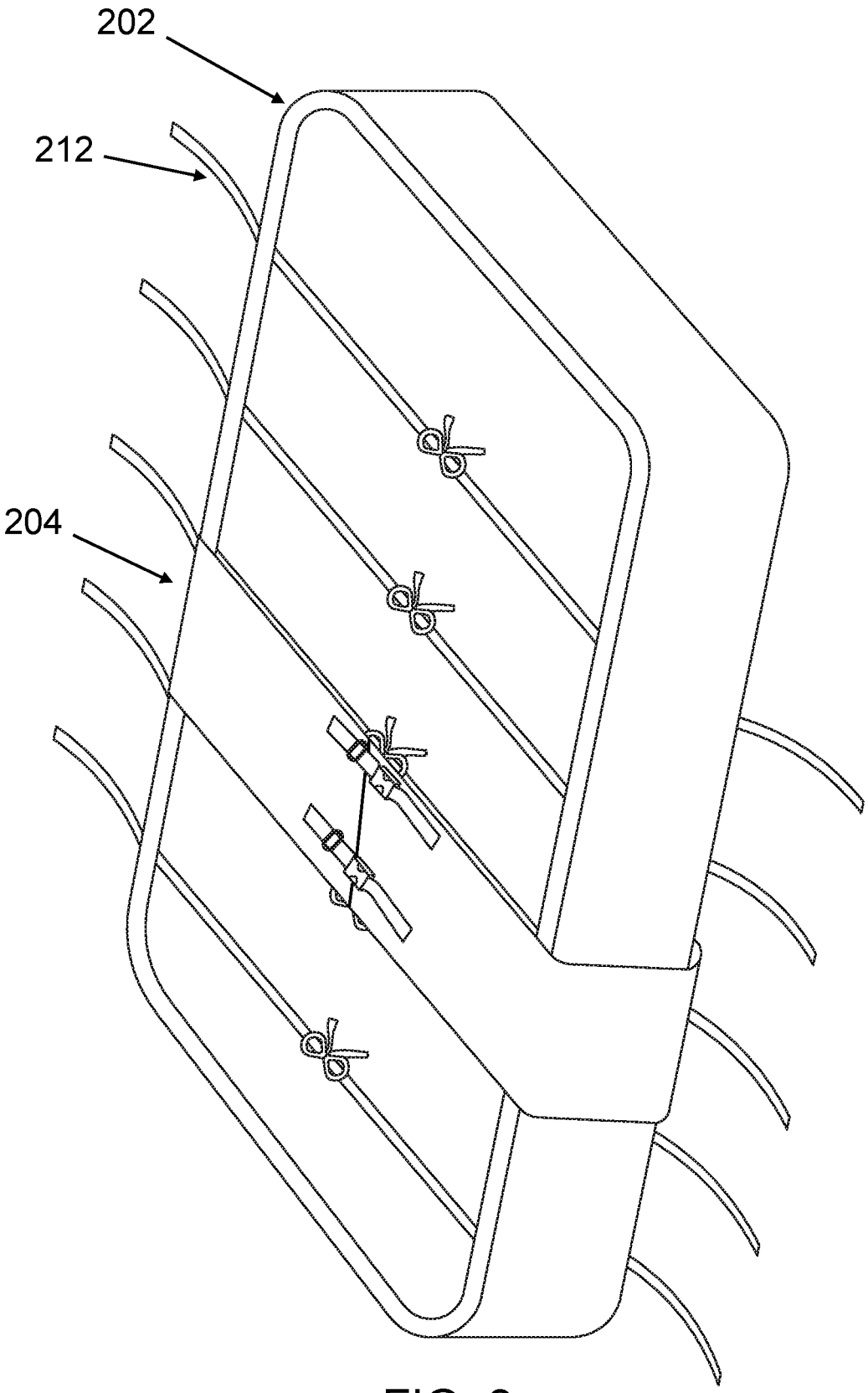
FIG. 8 depicts a bottom view of the bed sheet of the second embodiment.
Figure 9:
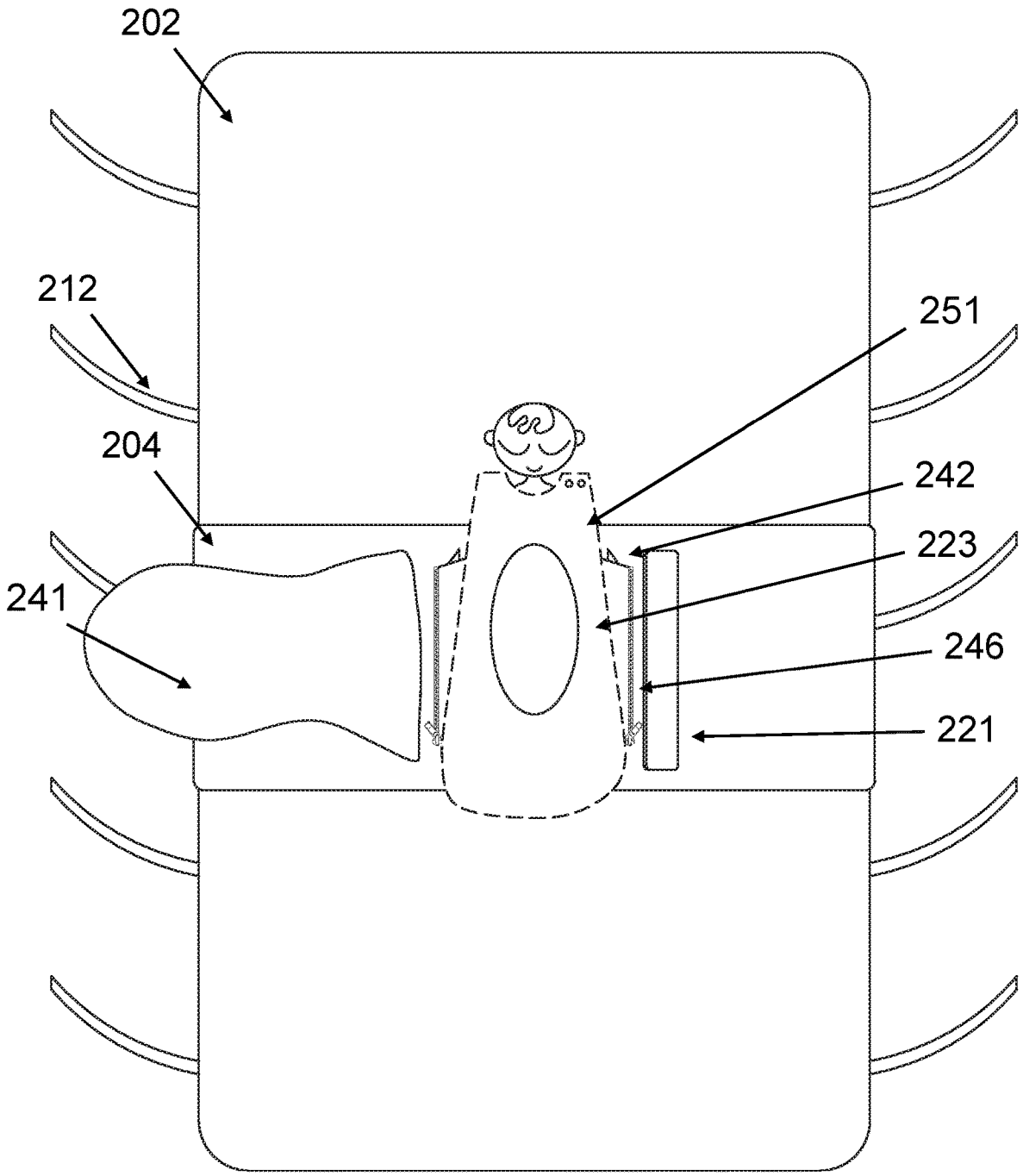
FIG. 9 depicts a top view of the safety wrap of the second embodiment.

An adjustable safety belt such as safety belt 204, in the form of an elongated strip, may wrap around bed sheet 202 and mattress as illustrated in FIG. 8. Safety belt 204 may be made of a fabric or flexible plastic and include a strap having a first end and a second end, a top surface and a bottom surface. To secure safety belt 204 around bed sheet 202 a series of release buckles may be used including a pair of male components on the first end and female components on the second end. Female components may be connected to male components on the underside of bed sheet 202 whereby safety belt 204 is removably secured to bed sheet 202. When the female components and male components are connected the connection provides for securing safety belt 204 to bed sheet 202 and the mattress to secure an infant who is placed or otherwise positioned in adjustable safety wrap such as safety wrap 206 as illustrated in FIG. 9.

Safety wrap 206 may be integral and a part of safety belt 204, sewn, or otherwise fastened to the top surface of safety belt 204 whereby safety wrap 204 may be folded over to help secure the infant in a selected position on their belt. Safety wrap 206 may include a flap 241 configured to pass through a slot such as slot 221 of a securement clip 242 positioned on the top surface of safety belt 204 by one or more Velcro® straps whereby safety wrap 206 may be folded over onto itself. Securement clip 242 may be integral to safety belt 204, sewn, or otherwise fastened to the top of safety belt 204.

Figure 10:
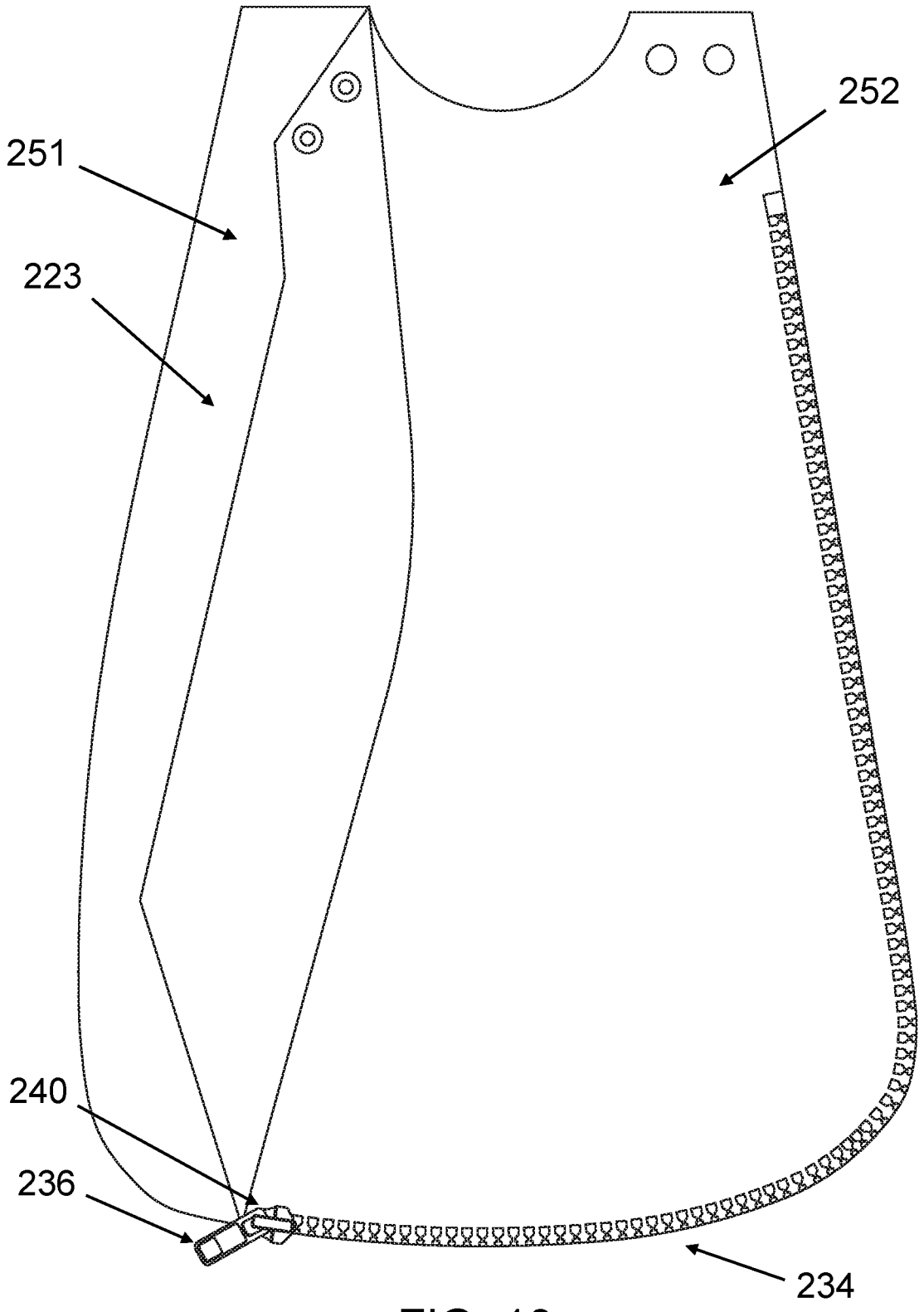
FIG. 10 depicts a view of the swaddle.
Figure 11:
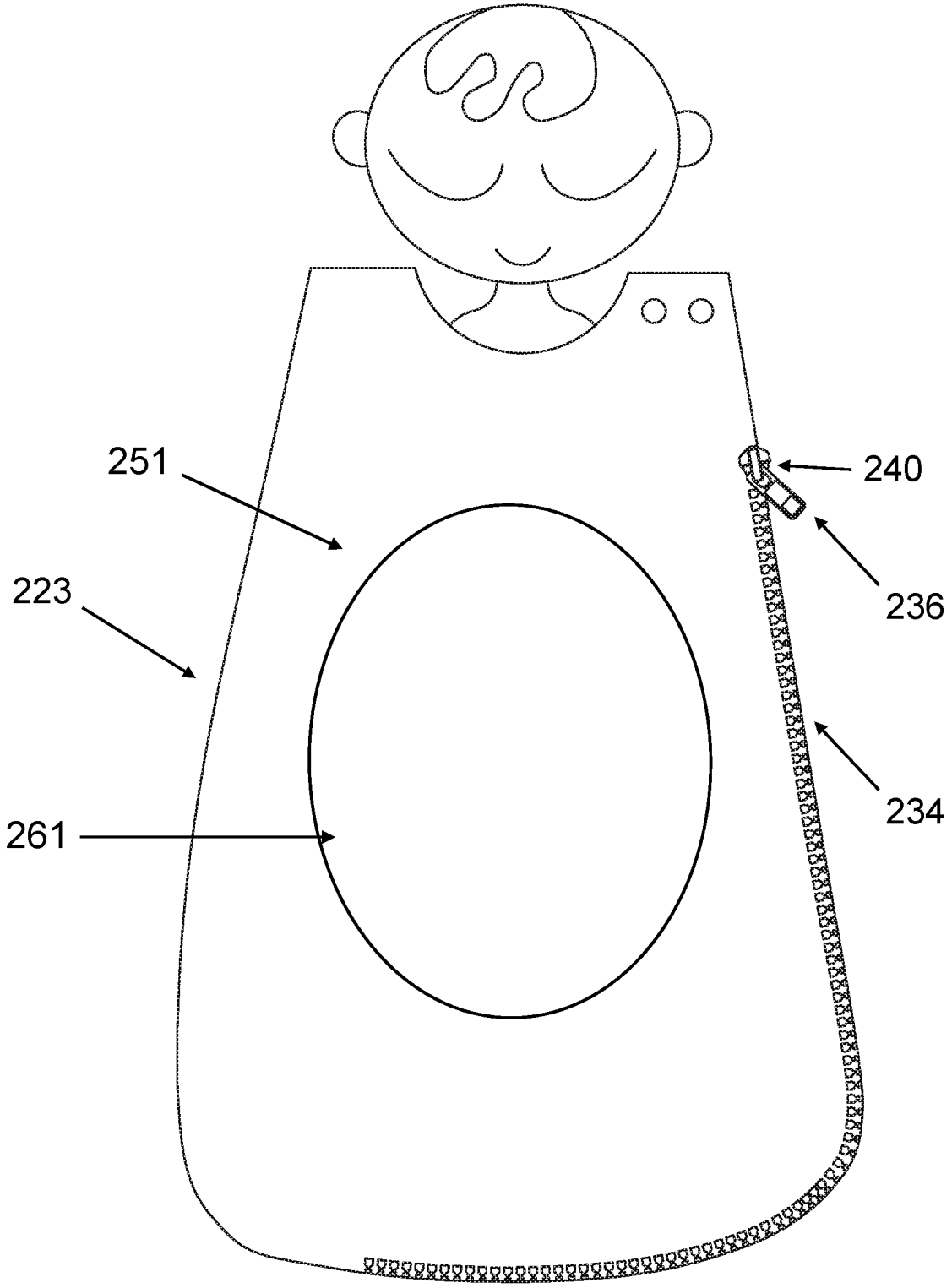
FIG. 11 depicts another view of the swaddle.

In one or more non-limiting embodiments, an infant may be wearing a swaddle such as swaddle 223 as illustrated in FIGS. 10 and 11, pajamas or another article of clothing that may be fastened to securement clip 242 of safety belt 204. Swaddle 223 may include a front panel 251 and back panel 252 or first and second side separated by a zipper chain 234 traversing across a length of the side, top, or bottom of swaddle 223. The term "sides" is used with embodiments directed to the swaddle 223 for convenience, not to suggest defined, or rigid walls. More specifically, the term "sides" as used with these embodiments relates to pliable sections of swaddle 223, separated from one another by a zipper. Swaddle 223 may include or more zipper pull tabs 236 attached to one or more sliders such as slider 240. Slider 240 may be configured to travel along complementary and separated zipper teeth tracks on the first and second sides to create a closed zipper chain 234, such that when closed an infant may be secured in swaddle 223. Conversely, when slider 240 travels in the opposite direction, it separates the complementary zipper tracks thereby opening the chain 234, allowing the infant to be removed from swaddle 223. Front panel 251 may have a flap 261 comprising a first and second end connected to the front surface of front panel 251 such that flap 261 may be pulled away from front panel 251 creating an aperture whereby flap 261 may pass through the aperture between flap 261 and front panel 251 further securing swaddle 223 to safety belt 204.

Figure 12:
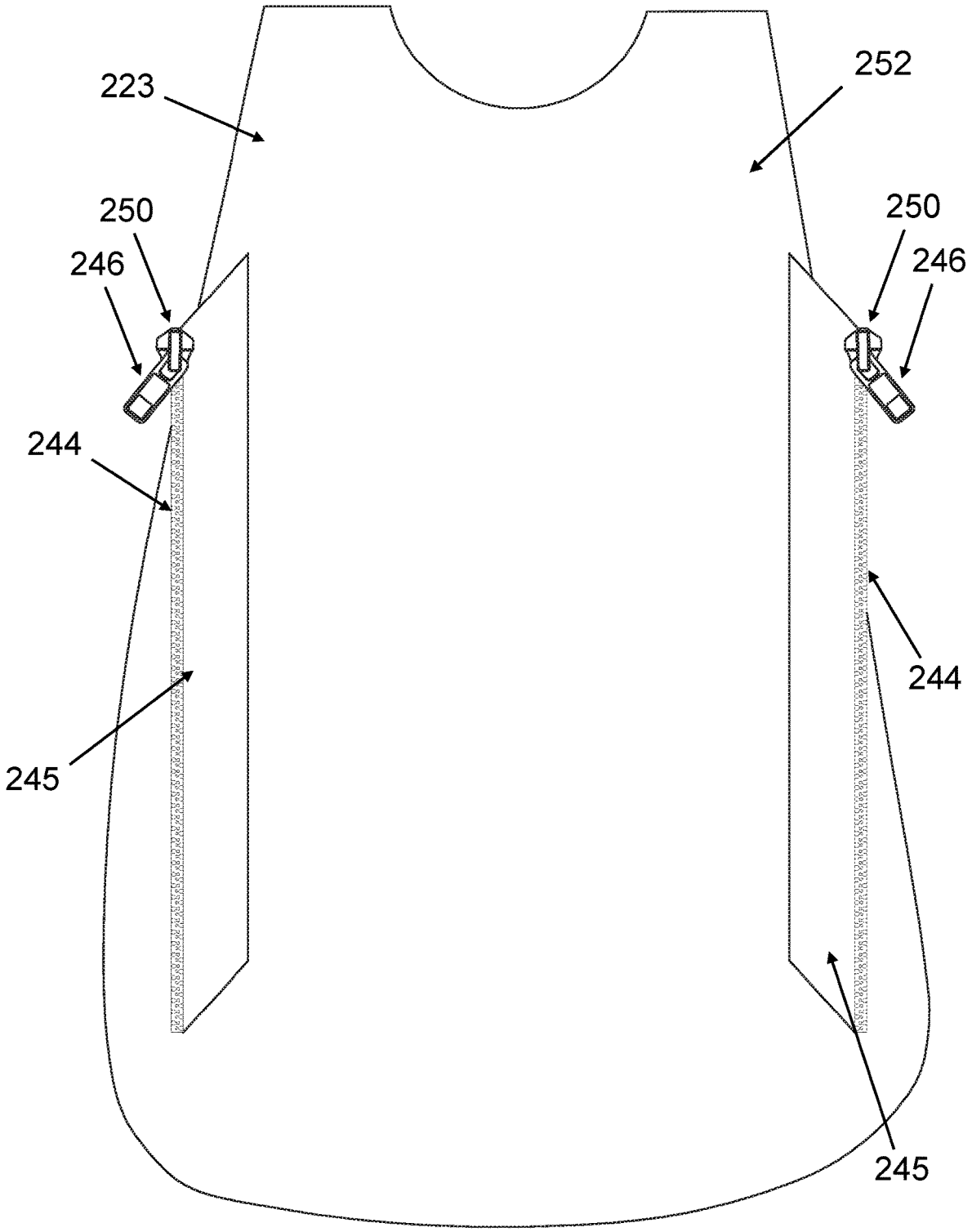
FIG. 12 depicts a back view of the swaddle and the connectable zipper chains.

In a similar fashion, swaddle 223 and securement clip 242 may be connectable by one or more zipper chains 244 as illustrated in FIG. 12, such as two zipper chains 244, traversing across a length of back or one or more flaps 245 on the back panel 252 of swaddle 223 and one or more flaps, strips, or a portion of securement clip 242. One or more zipper pull tabs 246 may be attached to one or more sliders such as sliders 250 whereby sliders 250 may be configured to travel along complementary and separated zipper teeth tracks on swaddle 223 and securement clip 242 to create closed zipper chains 244, securing swaddle to securement clip 242 and safety belt 204. Conversely, when a slider 250 travels in the opposite direction, it separates the complementary zipper tracks thereby opening the chain 244, allowing swaddle 223 to be removed from securement clip 242.

Figure 13:
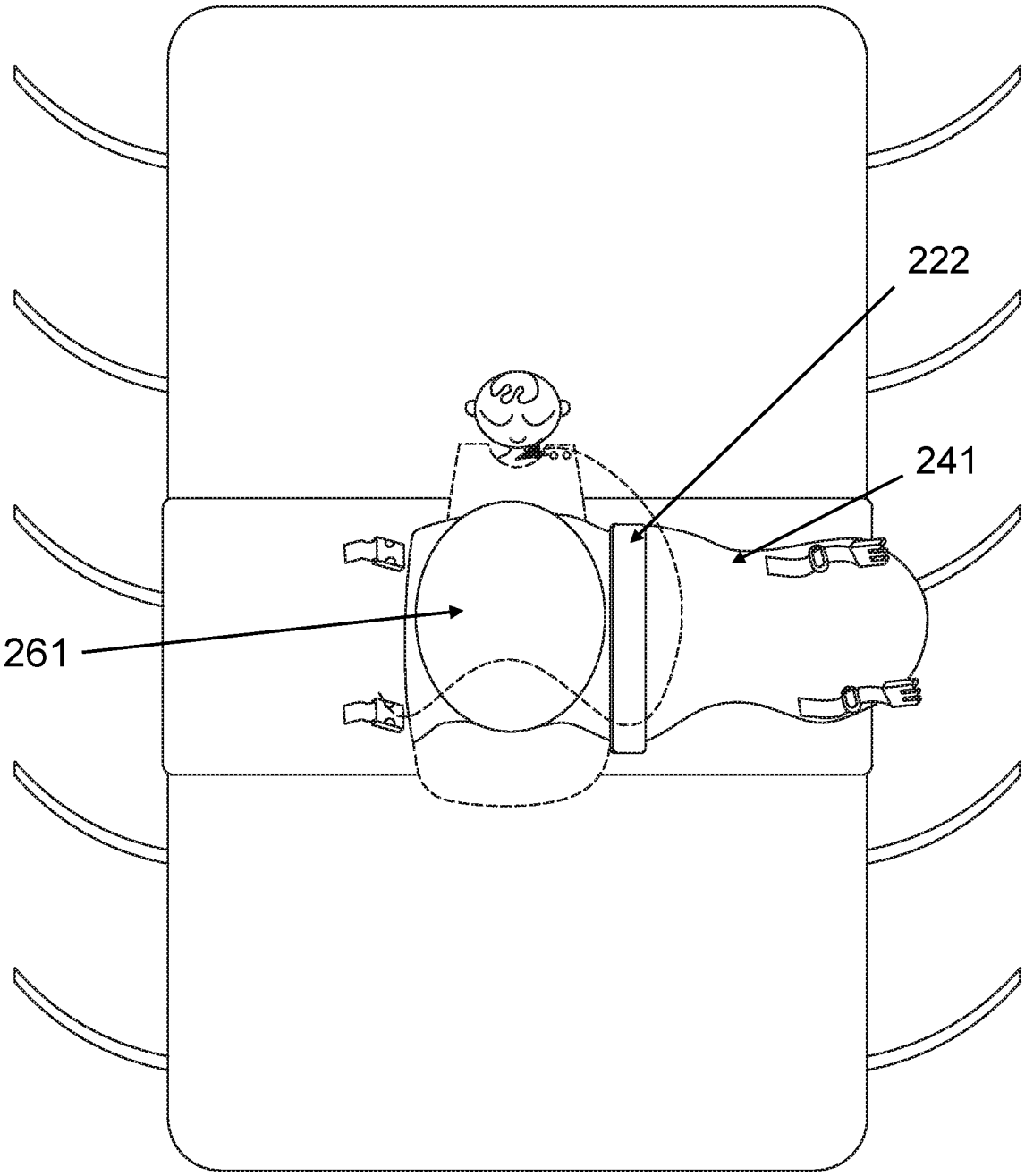
FIG. 13 depicts a top view of the flap being positioned through the slot of the second embodiment
Figure 14:
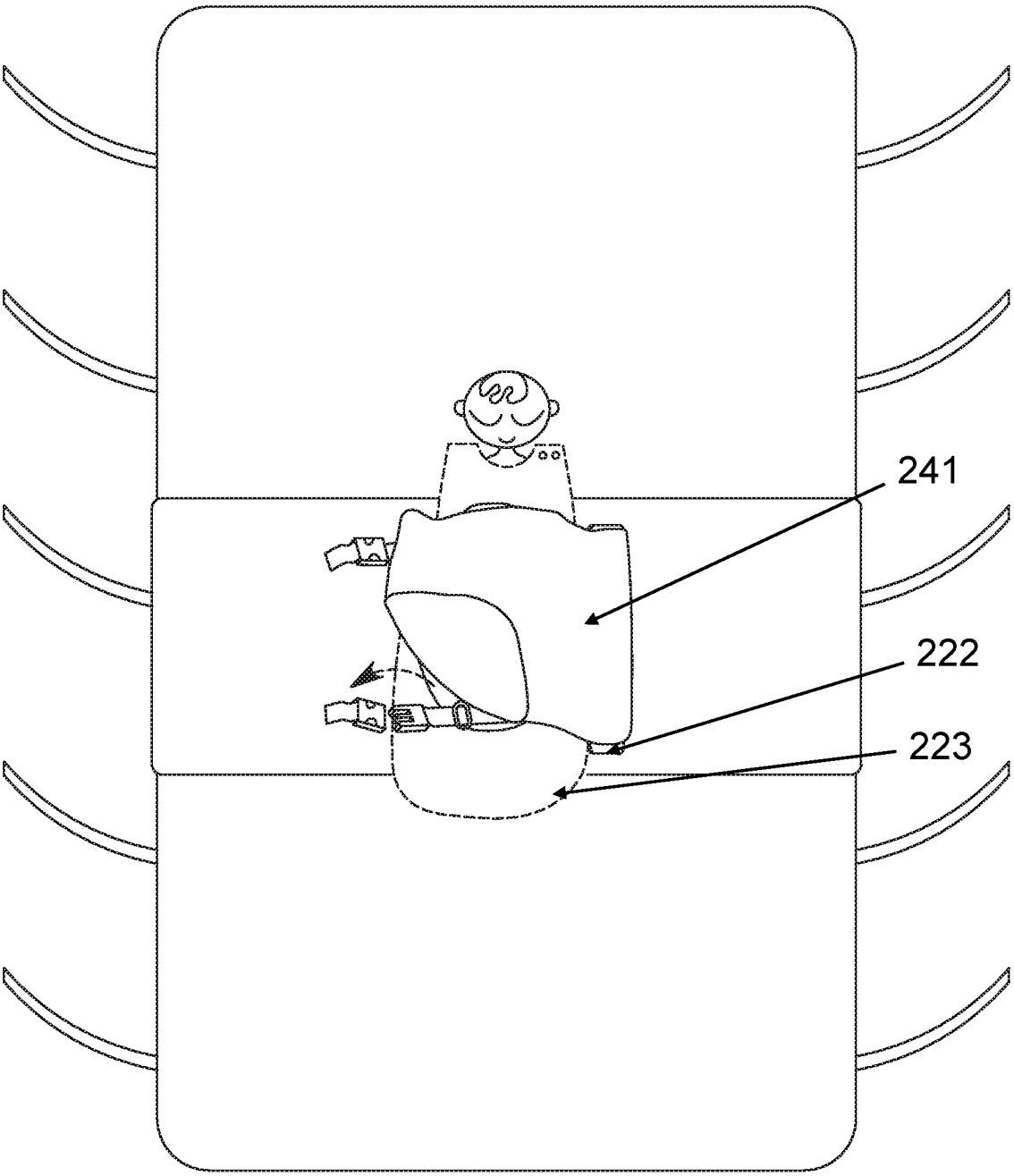
FIG. 14 depicts a top view of the flap being folded over in the second embodiment.

Once flap 241 passes through slot 221 as illustrated in FIG. 13, and flap 241 is folded over as illustrated in FIG. 14, safety belt 204 may be connected to safety wrap 206 by a series of release buckles including a pair of male components on safety wrap 206 and cooperating female component on securement clip 242 or on another part of safety belt 204. However this is non-limiting and female components may be on safety wrap 206 while the male components may be on securement clip 242 or another part of safety belt 204.

In some embodiments female components may be connected to and positioned inside pockets having openings built into safety belt 204. Other embodiments have buttons and eyelets, draw string, zippers, hook and loop fasteners, straps, or ties instead of hook and loop fasteners to secure safety wrap 206 and safety belt 204. The pockets may comprise chambers for containing the female components so the male components may connect with the female components inside of the chamber but an infant would not be able to come in contact with the buckles while secured. The chambers are preferably of the same size and shape but may be of any shape or size depending on the circumstances.

Figure 15:
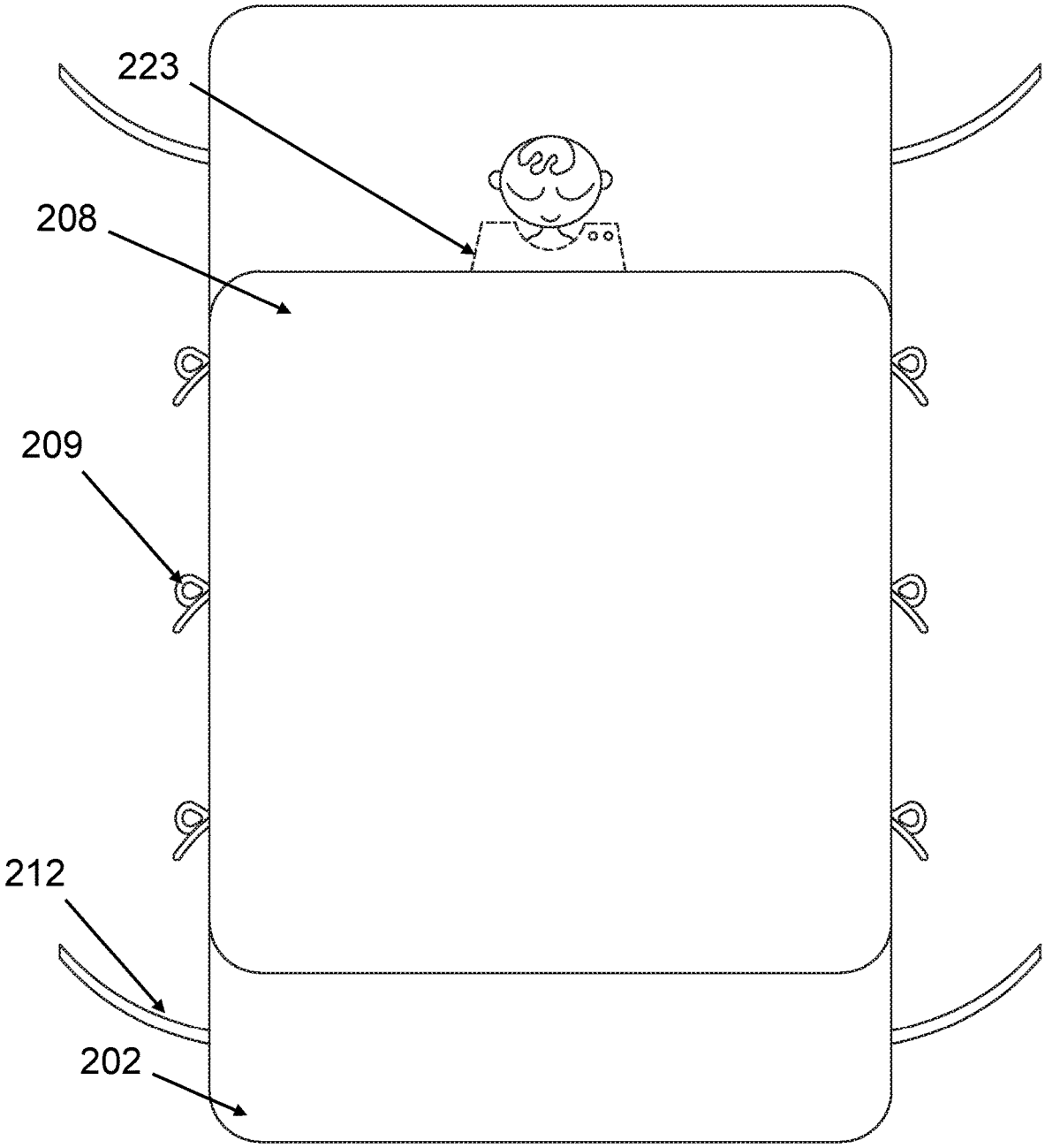
FIG. 15 depicts a top view of the blanket of the second embodiment.

A blanket 208 may be positioned over infant once secured in swaddle 223 as illustrated in FIG. 15. Blanket 208 may be generally rectangular in shape having a top surface, a bottom surface, and borders. Blanket 208 may be made of one layer or a multilayer of fabric material. Blanket 208 may have several positioned strips 209. Strips 209 may also be oriented at other angles depending on the circumstance and current need. Strips 209 may be tied to strips 212 wherein strips 212 of bed sheet 202 are removably fastened to strips 209 of blanket 208.

The foregoing description of the invention has been presented for purposes of illustration and description and is not intended to be exhaustive or to limit the invention to the precise form disclosed. Many modifications and variations are possible in light of the above teaching. The embodiments were chosen and described to best explain the principles of the invention and its practical application to thereby enable others skilled in the art to best use the invention in various embodiments and with various modifications suited to the use contemplated. The scope of the invention is to be defined by the below claims.

What is claimed is:

1. A system for securing infants, the system comprising:

a mattress;

a bed sheet;

a swaddle; and a safety belt configured to wrap around the bed sheet and the mattress, the safety belt securing an infant in a selected position on their back, the safety belt having one or more release buckles, the safety belt having a first component of the release buckle on a surface of a flap connected to a top surface of the safety belt and a second component on the too surface of the safety belt, the second component configured to cooperate with the first component, the swaddle having a front panel and back panel, the front panel and the back panel removably connected to each other by a zipper element, the front panel having a front flap connected to the front panel at a first and a second point on the front flap to create an opening, the flap on the safety belt is configured to pass over the infant, through the opening, through the slot and then be folded back over the infant and fastened with the one or more release buckles to secure the infant.

2. The system of claim 1, the swaddle removably fastened to the safety belt, wherein the second component is in a pocket on the safety belt.

3. The system of claim 1 further comprising: a blanket configured to cover an area of the infant, the blanket removably fastened to the bed sheet, the bed sheet having a plurality of strips on outer formed edges of the bed sheet along a length of the mattress wherein a plurality of strips of the blanket are configured to be tied to one or more of the plurality of strips of the bed sheet such that the blanket covers an area of the infant and is configured to being positioned at different orientations with respect to the infant.

4. The system of claim 1, the safety belt comprising a series of release buckles having male components and female components, the male and the female components configured to cooperate with each other, wherein the release buckles are configured to secure the safety belt over the bed sheet and the mattress.

5. A system for securing infants, the system comprising:

a safety belt, the safety belt securing an infant in a selected position on their back on a bed, the safety belt having one or more release buckles, the safety belt having a first component of the release buckle on a flap of the safety belt and a second component on a top surface of the safety belt, the second component configured to cooperate with the first component; and a swaddle wearable by the infant, the swaddle having a front panel and back panel, the front panel having a front flap connected to the front panel at a first and a second point on the front flap to create an opening, the flap on the safety belt is configured to pass through the opening, through a slot of the safety belt and then be folded over the infant and fastened with the one or more release buckles to secure the infant.

6. The system of claim 5 further comprising: a blanket configured to cover an area of the infant, the blanket removably fastened to the bed.

7. The system of claim 6, the blanket longitudinally adjustable with respect to the bed.

8. The system of claim 7, the blanket having one or more strips configured to be removably fastened to the bed, the blanket longitudinally adjustable with respect to the bed before the one or more strips are fastened to the bed, the bed having a plurality of strips on the outer edges along a length of the bed wherein a plurality of strips of the blanket are configured to be tied to one or more of the plurality of strips of the bed such that the blanket is configured to cover an area of the infant at different orientations with respect to the infant.

9. The system of claim 5, the swaddle removably fastened to the safety belt.

10. A system for securing infants, the system comprising:

a mattress;

a bed sheet;

a blanket configured to be positioned over an infant; and a safety belt configured to wrap around the bed sheet and the mattress, the safety belt securing an infant in a selected position on their back, the blanket having one or more buttons, the bed sheet having one or more holes configured to receive the one or more buttons, the blanket longitudinally adjustable with respect to the bed sheet before the one or more buttons are received into the one or more holes wherein the blanket is positionable at multiple orientations with respect to the bed sheet when secured, the bed sheet having one or more slits wherein the buttons of the blanket are configured to pass through the one or more slits to be received by the one or more holes.

11. The system of claim 10 further comprising: a swaddle, the swaddle having a front panel and back panel, the front panel and the back panel removably connected to each other by a fastening element, the swaddle removably connected to the safety belt.

12. The system of claim 10, the safety belt having one or more release buckles, the safety belt having a first component of the release buckle on a flap connected to the safety belt and a second component on a top surface of the safety belt, the second component configured to cooperate with the first component, wherein the safety belt is configured to pass through a slot on the safety belt and then be folded over wherein the first component is connected to the second component securing the safety belt over the infant.

* * * * *